US006275653B1

(12) United States Patent
Montipo'

(10) Patent No.: US 6,275,653 B1
(45) Date of Patent: Aug. 14, 2001

(54) STEAM APPLIANCE FOR DOMESTIC USE PROVIDED WITH A MANUALLY OR AUTOMATICALLY OPERATED DESCALING DEVICE

(75) Inventor: Fulvio Montipo', Reggio Emilia (IT)

(73) Assignee: General Technology S.R.L., Reggio Emilia (IT)

( * ) Notice: Subject to any disclaimer, the term of this patent is extended or adjusted under 35 U.S.C. 154(b) by 0 days.

(21) Appl. No.: 09/580,220

(22) Filed: May 26, 2000

(30) Foreign Application Priority Data

Jun. 7, 1999 (IT) ..... RE99A0068

(51) Int. Cl.[7] ..... A61H 33/12
(52) U.S. Cl. ..... 392/405; 392/494
(58) Field of Search ..... 239/79, 133; 122/18.2; 392/495, 491, 405, 494, 404

(56) References Cited

U.S. PATENT DOCUMENTS 1,940,506 * 12/1933 Peck ..... 239/133
2,530,799 * 11/1950 Arvintz et al. ..... 392/495
3,968,346 * 7/1976 Cooksley ..... 392/491
4,065,057 * 12/1977 Durmann ..... 239/79
4,479,484 * 10/1984 Davis ..... 122/18.2
5,784,531 * 7/1998 Mann et al. ..... 392/494
6,031,969 * 2/2000 Burr et al. ..... 392/404
6,148,144 * 11/2000 Milanese ..... 392/405

FOREIGN PATENT DOCUMENTS

2345921 * 7/2000 (GB) .
RE9400017 U 9/1995 (IT) .
20005104 * 11/2000 (JP) .

* cited by examiner

*Primary Examiner*—Teresa Walberg
*Assistant Examiner*—Leonid Fastovsky
(74) *Attorney, Agent, or Firm*—Birch, Stewart, Kolasch & Birch, LLP

(57) ABSTRACT

An appliance for domestic use, comprising a steam generating boiler consisting of an electrically heated body provided with a cylindrical through chamber fed at one end with water and provided at its opposite end with a delivery nozzle, that end of said chamber distant from the nozzle being closed by a removable wall associated with scraper means arranged to operate on the cylindrical wall of the boiler.

16 Claims, 7 Drawing Sheets

STEAM APPLIANCE FOR DOMESTIC USE PROVIDED WITH A MANUALLY OR AUTOMATICALLY OPERATED DESCALING DEVICE

This invention relates to small appliances for domestic use provided with a steam generator.

In particular the invention relates to steam cleaning appliances for domestic use, and specifically the steam generator, or boiler, with which they are provided.

Steam cleaning appliances of known type consist of an outer casing, generally shaped as a gun or at least provided with a gripping appendix, within which a pump is provided to draw water from a water container rigid with said casing, and to feed it to a small steam generator positioned downstream of the pump and connected to a delivery nozzle.

One of these appliances is fully described in utility model application No. RE94U000017 in the name of the present applicant.

Small steam generators must be fed with treated demineralized water to prevent the salts present in the water from clogging the device by depositing in the form of limestone on the inner walls of the generator.

Alternatively, to use untreated water the appliances must be provided with special means for reducing calcareous deposition on the inner walls of the generator. Both chemical means and electrically operated means are known for this purpose, the former consisting of ion exchange resin filters, and the latter comprising permanent magnets or coils positioned downstream of the water intake pump to generate an electrical field tending to orientate the salts contained in the water and in this manner limit their deposition on the inner walls of the steam generator.

The known means have proved inadequate in terms both of cost and efficiency, in particular because the ion exchange resin filters re not only of high unit cost, but have to be replaced with a certain frequency.

The object of the invention is to overcome the aforestated drawback within the context of a rational and reliable solution of particularly low cost.

The invention attains said object by virtue of a steam cleaning appliance for domestic use provided with means of mechanical type for removing calcareous deposits from the inner walls of the steam generator during or immediately after their formation.

In a first embodiment of the invention, there is provided inside the vaporization chamber a member which, when operated, rubs against the inner walls of the vaporization chamber to remove the deposits present on it.

Said member can be operated occasionally by the operator, to provide an action by which the calcareous deposits already formed during the use of the appliance are removed.

Said member can also be operated automatically by suitable means when the appliance is switched on, in which case there is continuous action preventing the formation of calcareous deposits.

Said member can be of various shapes, but in cross-section must have at least one portion in contact with the boiler inner walls so that when operated, it rubs against the walls of the vaporization chamber.

In a second embodiment of the invention, said member is not positioned permanently inside the vaporization chamber, but lies outside it, housed in a suitable seat in the appliance.

In this case the appliance is formed in such a manner as to enable the user to easily gain access to the vaporization chamber, to enable the deposits formed during use to be removed by said member.

The constructional characteristics of the invention will be more apparent from the ensuing description of some preferred embodiments thereof given by way of non-limiting example and illustrated on the accompanying drawings, on which:

FIGS. 6*a*, 7*a*, 8, 9 show different types of descaling devices usable by the invention.

Figure 6B:
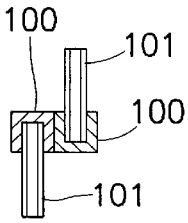
Figure 6A:
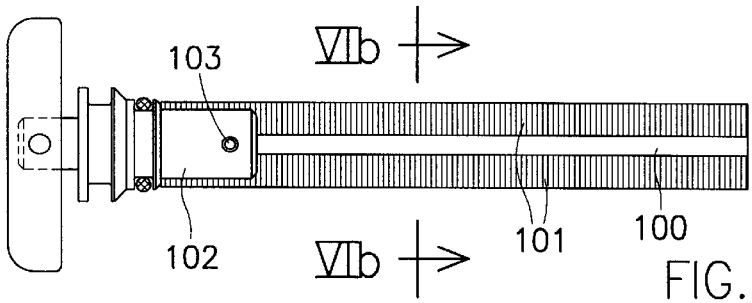

FIG. 6*b* is a section on the line VIb—VIb of FIG. 6*a*.

Figure 7B:
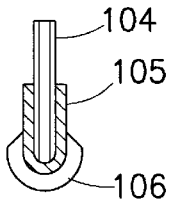
Figure 7A:
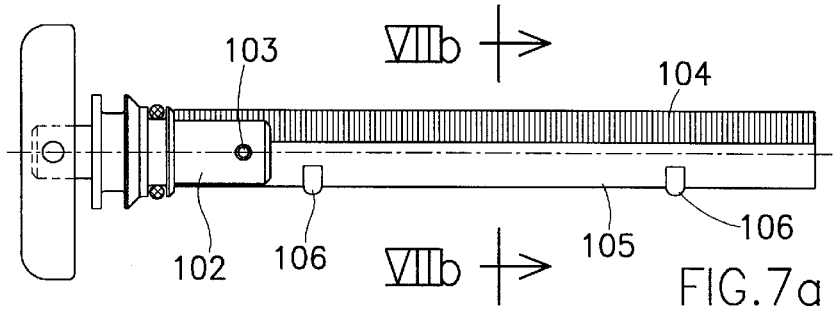

FIG. 7*b* is a section on the line VIIb—VIIb of FIG. 7*a*.

Figure 11:
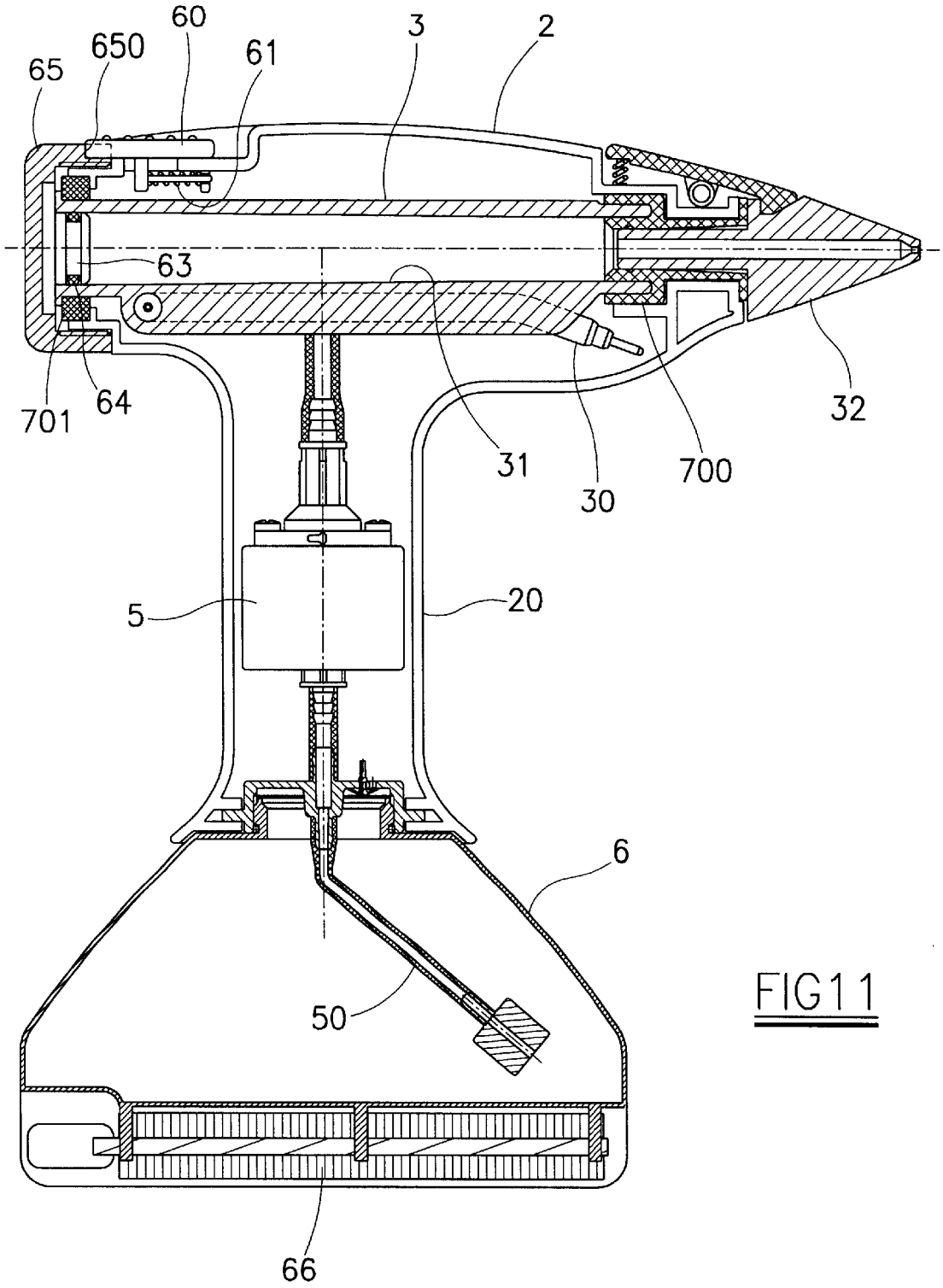

FIG. 11 is a partial section through a second embodiment of the steam cleaning appliance.

Figure 12:
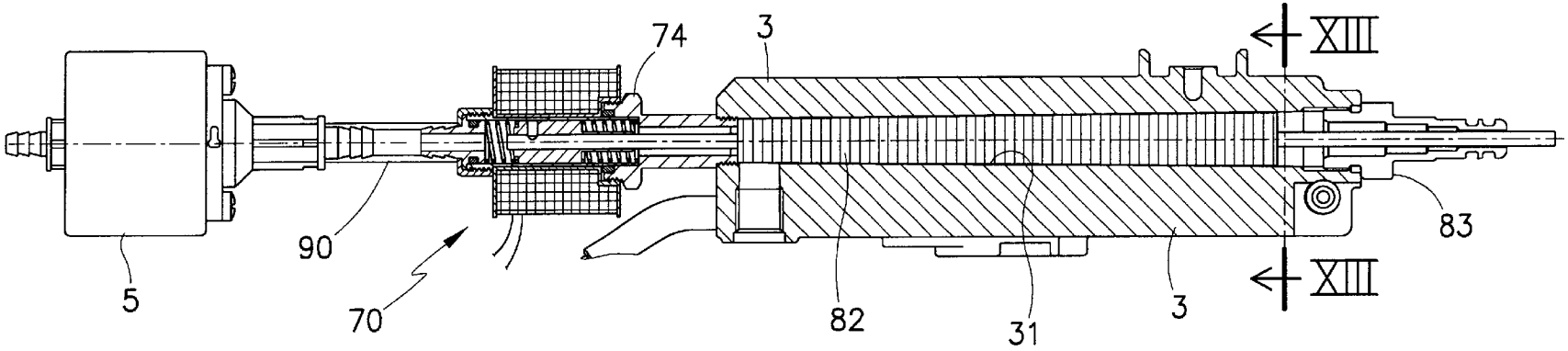

FIG. 12 is a section through a third embodiment of the invention.

Figure 13:
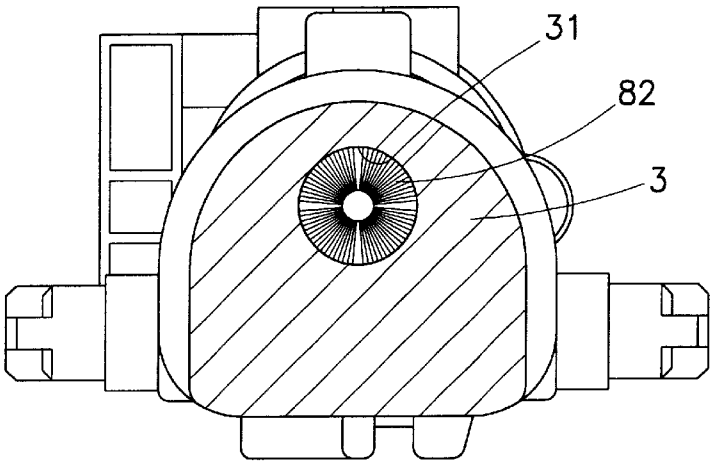

FIG. 13 is a section on the line XIII—XIII of FIG. 12.

Figure 14:
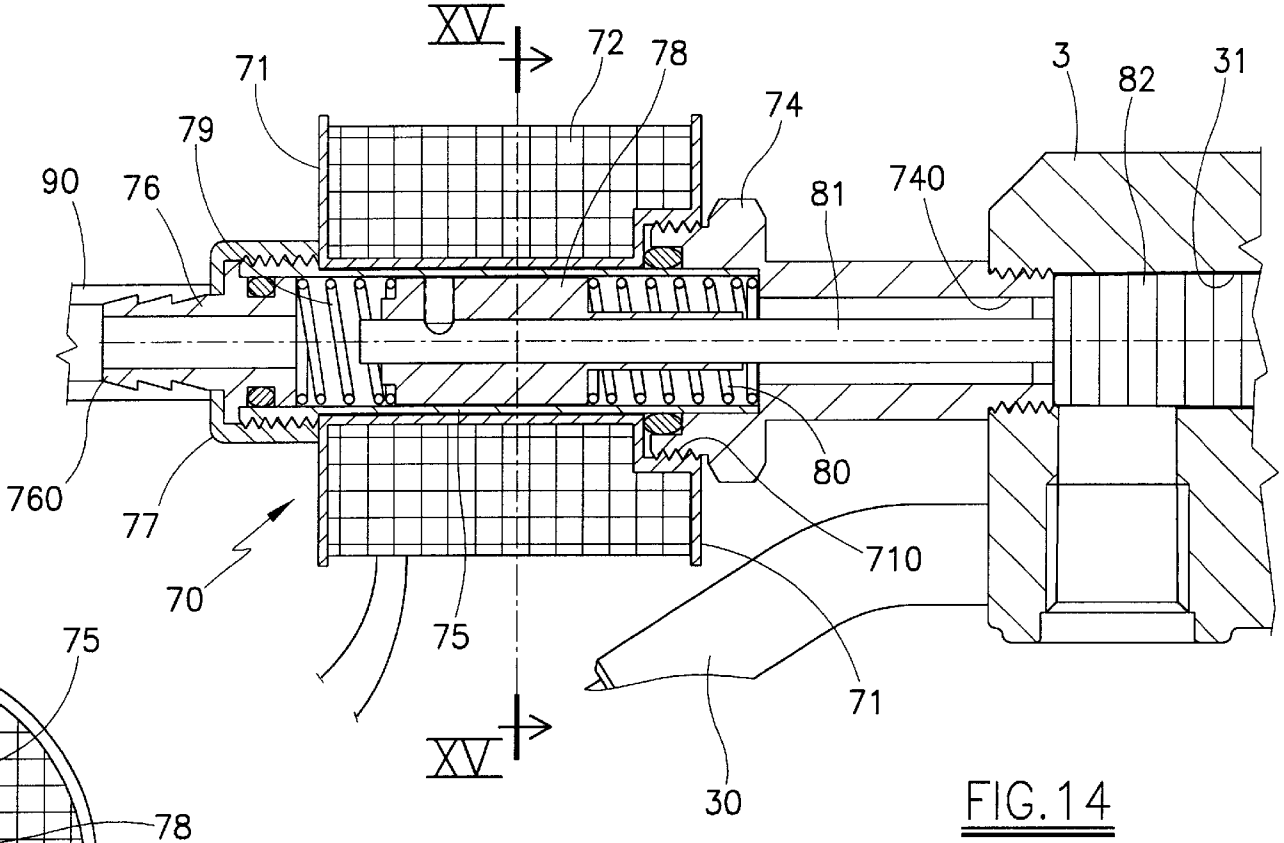

FIG. 14 is an enlargement of the magnetic actuator with which the third embodiment of the invention is provided.

Figure 15:
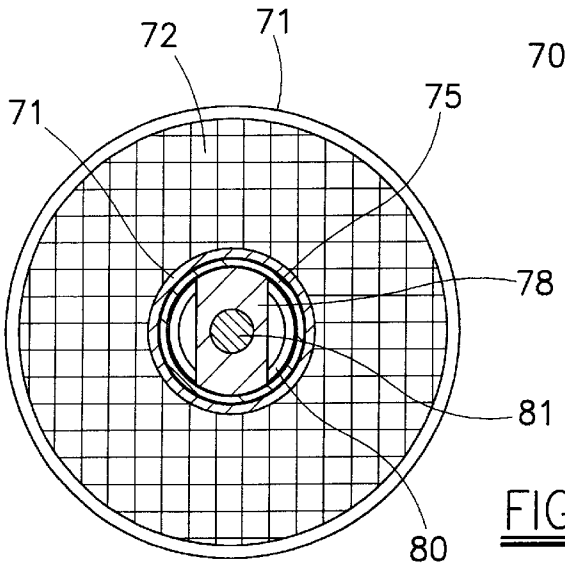

FIG. 15 is a section on the line XV—XV of FIG. 12.

Figure 1:
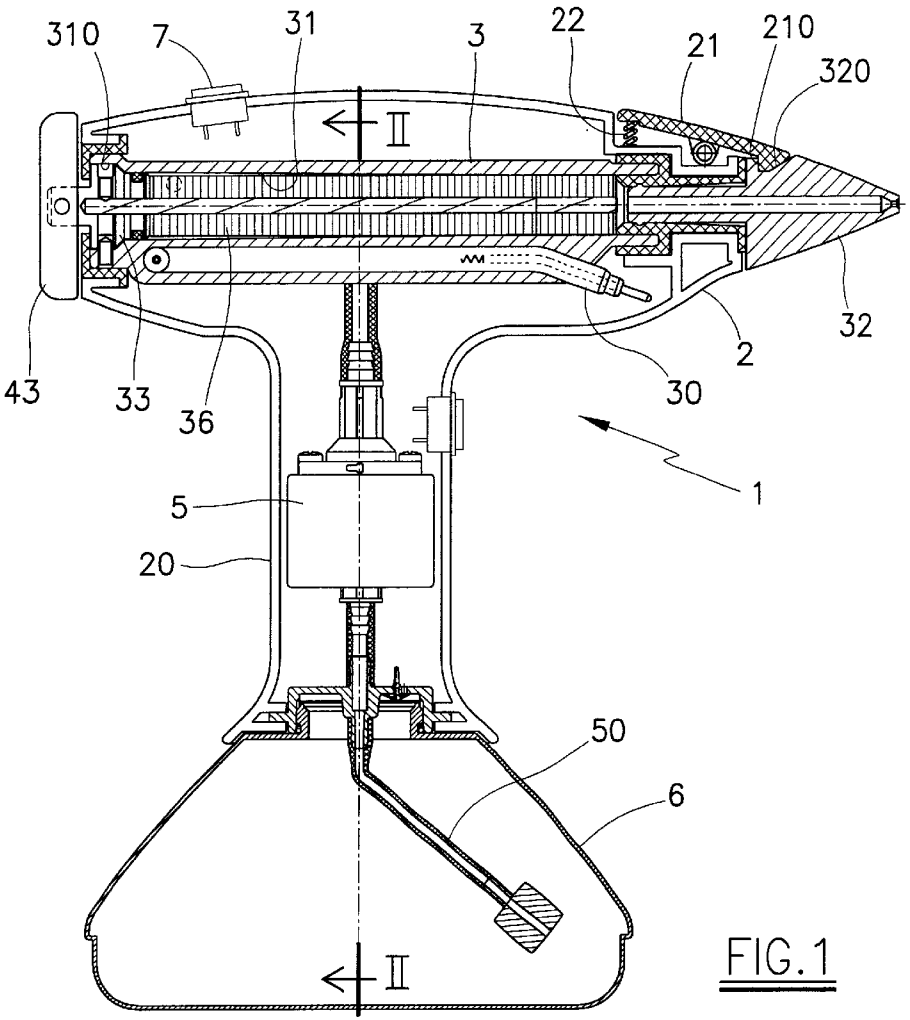
FIG. 1 is a partial section through a first embodiment of a steam cleaning appliance of the invention.
Figure 2:
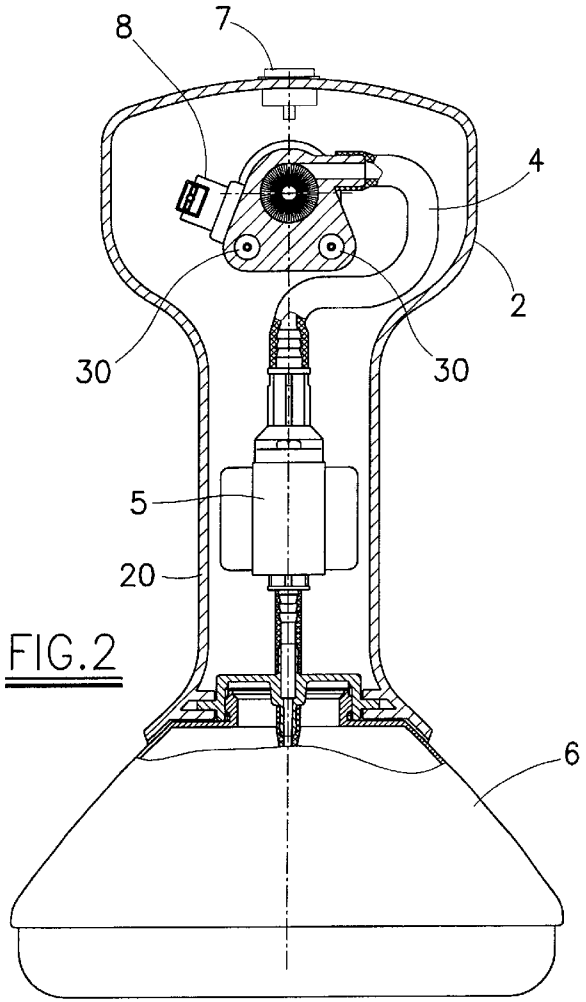
FIG. 2 is a section on the line II—II of FIG. 1.

FIGS. 1 and 2 show the cleaning appliance 1, comprising a gun-shaped outer casing 2 provided with a handgrip 20.

The outer casing 2 is formed from two half-casings joined together by screws, not shown, and containing seats for receiving and fixing a steam generator 3 by way of suitable interposed insulation elements.

The steam generator is fed via the pipe 4 by a pump 5 having a capacity of between 25 and 45 $cm^3$/minute.

The pump 5, of commercially available type, is housed in the handgrip 20 and draws water through a tube 50 inserted into a container 6 screwed to the base of the handgrip 20.

The steam generator 3 is of cast aluminum and carries, embedded in its wall, a U-bent resistance element 30, the ends of which are connected to the electricity supply line via an on-off switch 7 and a maximum-temperature thermostat 8.

The steam generator 3 comprises a vaporization chamber 31, to one end of which a delivery nozzle 32 is connected by snap-insertion into the casing 2. The delivery nozzle 32 is maintained locked in position by a rocker pawl 21 provided at one end with a tooth 210 inserted into a matching cavity 320 in the nozzle 32, and normally maintained within said cavity by a spring 22.

The nozzle 32 can be replaced with nozzles of different form according to the type of surface to be treated by the user.

The opposite end of the vaporization chamber 31 has a wide seat 310 for receiving a member 33 forming the rear wall of the chamber.

The member 33 has a front stem 34 provided with a seal gasket 35, and from which there extends a stainless steel tube brush acting as a descaling device.

The tube brush 36 is the same length as the vaporization chamber 31, and has a diameter just less then or equal to the inner diameter of the chamber.

Figure 3:
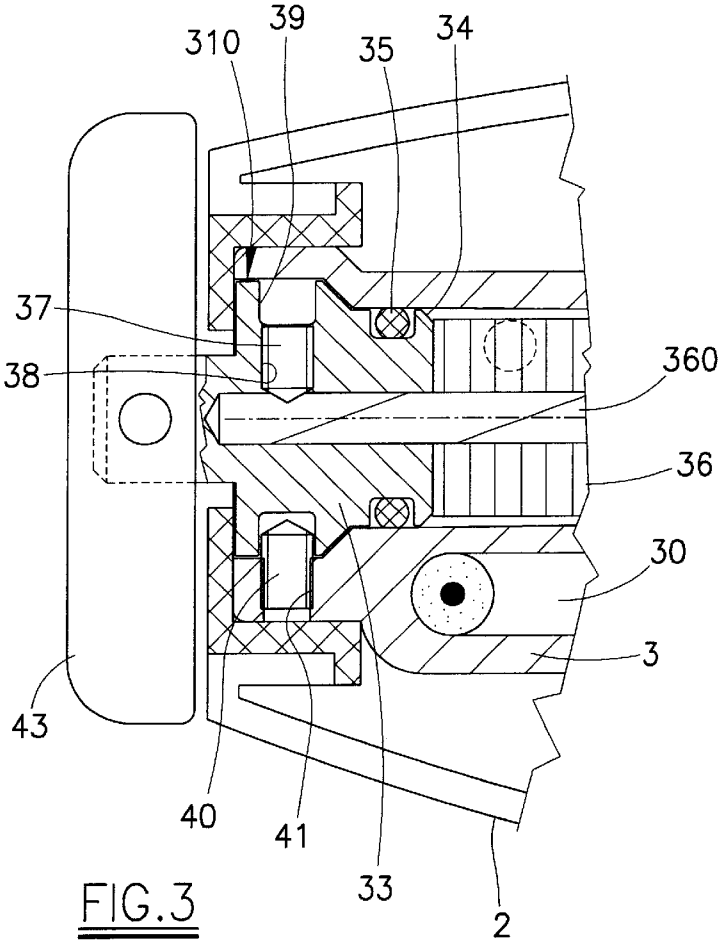
FIG. 3 is an enlargement of a part of FIG. 1.

With reference to FIG. 3, the tube brush 36 is provided with a central rod 360, one end of which is received in a hole in the member 33, and is fixed into this hole by a setscrew 37 screwed through a hole 38 provided in the base of an annular groove 39 in the member 33.

Said groove is also engaged by the front end of a second setscrew 40, which acts as a safety element, and emerges from a threaded hole 41 provided in proximity to the rear end of the generator 3.

From the description it is apparent that the member 33 is prevented from traversing axially, but not from rotating about its axis.

From the rear end of said member 33 there extends an appendix which emerges from the rear of the casing 2 and is connected by usual means to an operating knob 43.

When the user rotates the knob 43 he causes the member 33 and its connected tube brush 36 to rotate. By rotating, the tube brush 31 rubs against the walls of the chamber 31 and removes the scale which has formed during the appliance operation. The removed scale, in the form of powder, is then expelled from the chamber 31 via the nozzle 32 when the appliance 1 is next used.

FIGS. 6*a*, 6*b*, 7*a*, 7*b*, 8, 9 and 10 show some descaling devices alternative to the tube brush 36.

In detail, FIGS. 6*a* and 6*b* show a descaling device consisting of two identical blocks 100 welded together, each carrying on one side a comb 101 having its teeth of steel or of any other material suitable for the purpose. The two blocks 100 are fixed to a member 102 by a pin 103.

The member 102, which is similar to the member 33 of the described first embodiment, is inserted into the vaporization chamber 31, of which it forms the rear wall.

FIGS. 7*a* and 7*b* show a descaling device comprising a single comb 104 inserted into a channel-bent metal plate 105 maintained in position by two retainers 106. The plate 105 is fixed to the member 102 by a pin 103.

Figure 8:
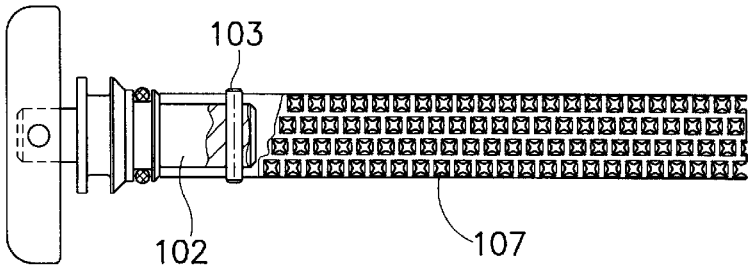

FIG. 8 shows a descaling device consisting of a hollow cylinder 107, the surface of which is machined to form a "grater". The hollow cylinder 107 is fixed to the member 102 by a pin 103.

Figure 9:
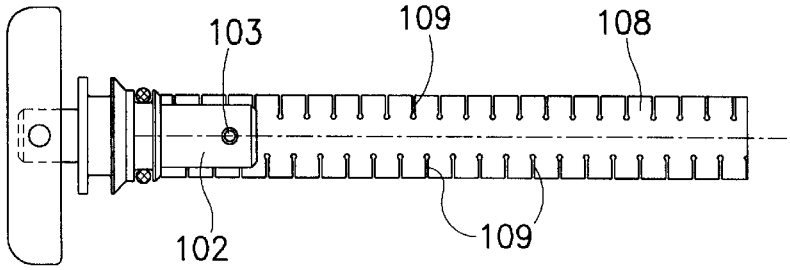

FIG. 9 shows a further descaling device consisting of a flat plate 108 comprising two series of parallel opposing cuts 109. The plate 108 is fixed to the member 102 by a pin 103.

Figure 10:
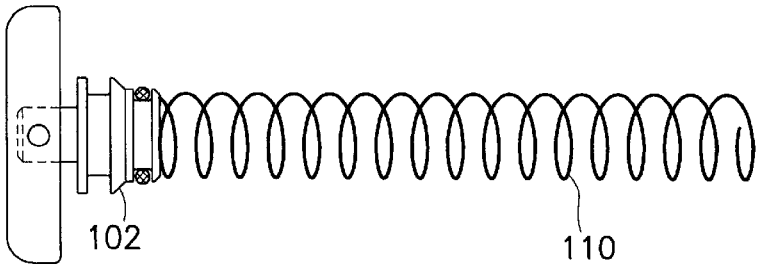

Finally, FIG. 10 shows a descaling device consisting of a spring 110 constructed of steel of square cross-section and fixed to the member 102 by usual means.

Figure 5:
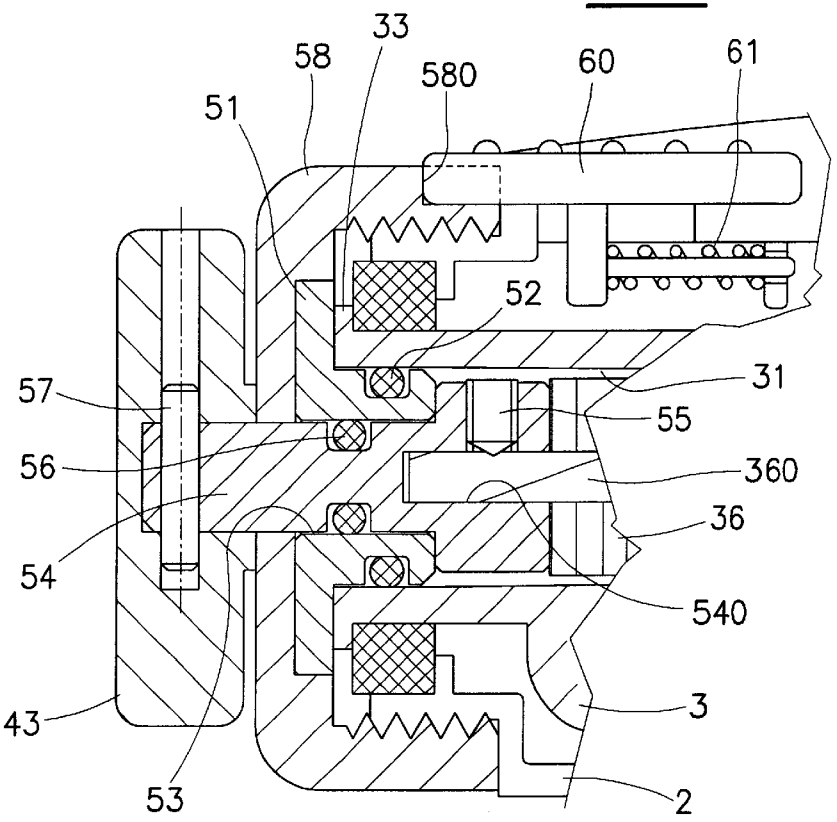
FIG. 5 is an enlargement of a part of FIG. 4.
Figure 4:
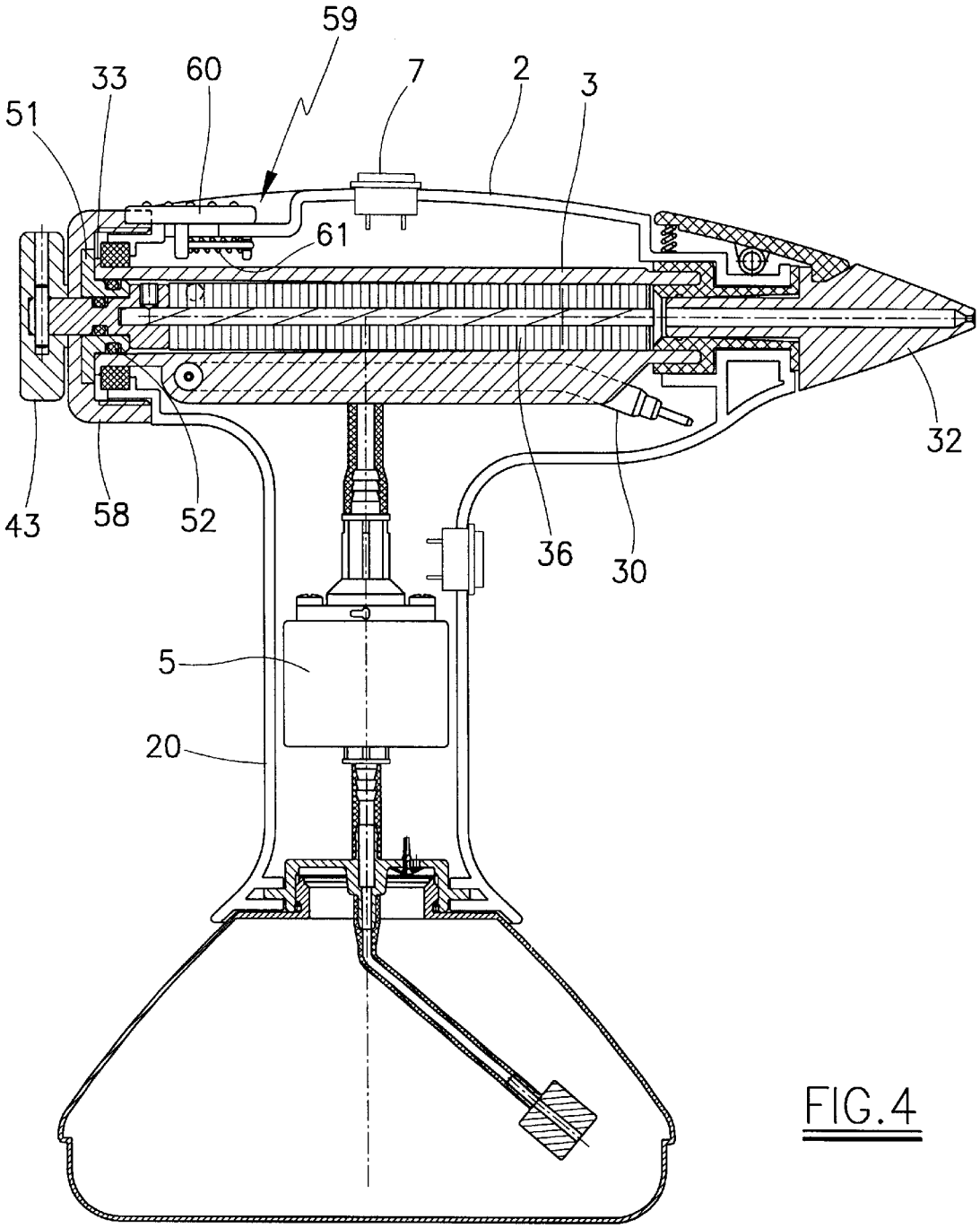
FIG. 4 is a partial section through a variant of the first embodiment of the steam cleaning appliance.

FIGS. 4 and 5 show a first variant of the invention which differs from the described first embodiment in that it gives the user access to the vaporization chamber without having to open the casing 2, to enable its inner walls to be cleaned by chemical descaling solutions or be cleaned by suitable tools.

The description of this first variant uses the same reference numerals for components identical with those already described in the first embodiment.

These figures show the boiler 3, provided at its rear with an annular flange 33 and receiving a bush 51 having an annular groove for housing the seal gasket 52.

Said bush 51 has a central hole 53 for receiving a pin 54 carrying the tube brush 36 inserted into the vaporization chamber 31.

The pin 54 has a cavity 540 in which the end of the rod 360 carrying the tube brush 36 is received and locked by a setscrew 55.

The pin 54 also has an annular groove for housing a seal gasket 56.

The pin 54 emerges from the rear of the casing 2 and is connected to a knob 43 by a pin 57.

Between the knob 57 and the bush 51 there is a cover 58, which is screwed onto the rear end of the casing 2.

The cover 58 has a groove 580 which, when the cover 58 has been completely screwed down onto the casing 2, lies exactly in front of a catch 60 positioned on the casing 2.

The front end of the catch 60 is normally inserted into the groove 580 in the cover by the action of the spring 61.

In this manner, an anti-unscrewing safety device is formed for the cover 58. In this respect, to unscrew the cover 58 the user has to voluntarily withdraw the catch 60 against the action of the spring 61 and disengage it from the groove 580, in order to unscrew the cover.

This variant of the invention enables the vaporization chamber 31 to be more accurately cleaned. With this, the user can eliminate scale deposited on the inner walls of the device either by using the tube brush 36, ie by rotating it by operating the knob 41, or by extracting the tube brush 36 from the vaporization chamber 31 and using commercial descaling solvents.

FIG. 11 shows a second embodiment of the invention.

In this figure and in the description of the second embodiment of the invention, components identical to those already described in the first embodiment carry the same reference numerals as these latter.

This second embodiment differs from the preceding in that the descaling device is not normally positioned inside the vaporization chamber 31. It is supplied as a separate piece and can be housed in an appropriate seat provided for example in the base of the container 6, as shown in FIG. 11.

As can be seen in FIG. 11, suitable seats are provided in the casing 2 for housing the boiler 3 by way of a front flange 700 and a rear elastomer ring 701.

The rear wall of the vaporization chamber 31 is in the form of a plug 63 provided with a seal gasket 64.

The plug 63 is rigidly fixed to a cover 65 screwed onto the rear end of the casing 2. Again in this case the appliance 1 is provided with an anti-unscrewing device which, as in the preceding embodiment, is in the form of a catch 60, the front end of which is received in a groove 650 provided in the edge of the cover 65, and is normally maintained within said groove 650 by the action of the spring 61.

Then the user wishes to remove the scale formed during the use of the device from the walls of the vaporization chamber 31, he unscrews the cover 65 while maintaining the catch 60 in its withdrawn position against the action of the screw 61, and then withdraws the plug 63.

At this point he can clean the appliance by using the tube brush 66, possibly in combination with commercial descaling solvents.

FIGS. 12, 13, 14 and 15 show a further embodiment of the invention, which differs from the preceding in that the descaling device is operated automatically by means activated by switching on the cleaning appliance. Said figures do not show the outer casing of the device, which can be of any shape provided it can contain the described means.

From these figures it can be seen that the boiler 3 is fed by a pump 5 drawing water from a container, not shown. Between the pump 5 and the boiler 3 there is a magnetic actuator 70, the purpose of which is to cause the tube brush 82 inside the vaporization chamber 31 to move axially, in the manner of the already described tube brush 36.

Specifically, with reference to FIGS. 12 and 14, said magnetic actuator 70 comprises a spool 71 of insulating material, about which a coil 72 is wound.

The spool 71 has a threaded annular widening 710 into which the end of that part 74 connecting the actuator 70 to the boiler 3 is screwed.

The other end of the part 74, which has a central bore 740, is screwed into the rear end of the boiler 3.

The part 74 has a central seat for receiving one end of a cylindrical tube 75 inserted through the interior of the spool 71.

The other end of said tube receives a centrally bored connector 76 for connection to the delivery 90 of the pump 5.

The connector 76 is secured to the tube 75 by a cover 77 screwed onto the outer surface of the tube.

Inside the tube 75 there is positioned a moving core 78 centered between two springs 79 and 80. Said moving core 78 receives and retains one end of the rod 81 of the tube brush 82, the other end of which is slackly received and guided within the axial hole of a profiled nozzle, shown in FIG. 12.

From FIG. 15, it can be seen that the moving core 78 is of non-circular cross-section to enable water to pass towards the boiler 3.

On switching on the appliance, the coil 72 is powered with a pulsating electrical voltage which generates a magnetic field, the electromotive force of which acts on the moving core 78.

Said electromotive force causes the core 78, and hence the tube brush 82, to move against the action of the spring 80. As the tube brush advances it rubs against the inner walls of the chamber 31 to remove any scale.

When the feed voltage returns to zero on termination of each cycle, the spring 80 returns the moving core into its initial position, against the action of the spring 79 which slows its travel. At this point the tube brush is ready for the next cleaning cycle.

What is claimed is:

1. An appliance for domestic use, comprising a steam generating boiler consisting of an electrically heated body provided with a cylindrical through chamber fed at one end with water and provided at its opposite end with a delivery nozzle, characterised in that that end of said chamber distant from the nozzle is closed by a removable wall associated with scraper means arranged to operate on the cylindrical wall of the boiler.

2. An appliance as claimed in claim 1, characterised in that the removable wall is accessible from the outside of the appliance, said scraper means being in the form of a slightly deformable cylindrical element of diameter less than or equal to that of the cylindrical chamber of the boiler and having an axial stem which sealedly emerges to the outside of the boiler, to be secured to the removable wall by means which enable it to rotate but not to move axially.

3. An appliance as claimed in claim 2, characterised in that said axial stem carries an operating knob on that end external to the appliance.

4. An appliance as claimed in claim 2, characterised in that said cylindrical element is in the form of a brush with radial bristles.

5. An appliance as claimed in claim 2, characterised in that said cylindrical element is in the form of a knife supported by an axial shaft.

6. An appliance as claimed in claim 2, characterised in that said cylindrical element is in the form of a surface machined as a grater.

7. An appliance as claimed in claim 2, characterised in that said cylindrical element is in the form of a spiral of abrasive wire.

8. An appliance as claimed in the preceding claims, characterised in that said scraper means can be housed in an external cavity in the appliance casing, and be inserted into and operated within the cylindrical chamber of the boiler after removing the removable wall thereof.

9. An appliance as claimed in claim 1, characterised in that said scraper means are in the form of a cylindrical element and comprise a through axial shaft which at one end passes through the removable wall of the boiler and at the other end is inserted loosely into the nozzle, with said shaft there being associated a moving core inside a coil fed with pulsating current and maintained in a rest position by suitable elastic means.

10. An appliance as claimed in claim 9, characterised in that the through axial shaft passes sealedly through the removable wall of the boiler, which is fed with water via a conduit not included in said wall.

11. An appliance as claimed in claim 9, characterised in that said through axial shaft passes sealedly through the removable wall while inside the water feed conduit, which passes through said coil and comprises a widening within which the mobile core of the coil is positioned.

12. An appliance as claimed in claim 11, characterised in that the moving core is of non-circular shape to enable water to pass though the conduit in which said core is contained.

13. A boiler for domestic appliances using small quantities of steam, consisting of an electrically heated body provided with a cylindrical through chamber fed at one end with water and provided at its opposite end with a steam exit port, characterised in that that end of said chamber distant from the port is closed by a removable wall associated with scraper means arranged to operate on the cylindrical wall of the boiler.

14. A boiler as claimed in claim 12, characterised in that said scraper means comprise an abrasive-walled cylindrical element inserted into the boiler as an exact fit.

15. A boiler as claimed in claim 12, characterised in that said scraper means are operated manually.

16. A boiler as claimed in claim 12, characterised in that said scraper means are operated by an electromagnetic field.

* * * * *